US006765461B1

(12) United States Patent
Botka et al.

(10) Patent No.: US 6,765,461 B1
(45) Date of Patent: Jul. 20, 2004

(54) ASYMMETRIC SUPPORT FOR HIGH FREQUENCY TRANSMISSION LINES

(75) Inventors: Julius K Botka, Santa Rosa, CA (US); Floyd A Bishop, Santa Rosa, CA (US); Jon L. James, Sebastopol, CA (US); Michael T. Powers, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/427,875

(22) Filed: Apr. 30, 2003

(51) Int. Cl.[7] ..... H01Q 13/22
(52) U.S. Cl. ..... 333/237; 333/244
(58) Field of Search ..... 333/222, 236, 333/237, 242, 243, 244

(56) References Cited

U.S. PATENT DOCUMENTS 3,870,977 A * 3/1975 Peoples et al. ..... 333/237
4,035,054 A 7/1977 Lattanzi ..... 439/578
4,669,805 A 6/1987 Kosugi et al. ..... 439/581
5,339,058 A * 8/1994 Lique ..... 333/237
5,696,474 A 12/1997 Spivey et al. ..... 333/265
5,742,002 A * 4/1998 Arredondo et al. ..... 174/29
5,817,981 A * 10/1998 Arroyo ..... 174/110 N

FOREIGN PATENT DOCUMENTS

JP 405235611 A * 9/1993

OTHER PUBLICATIONS

Agilant Technologies, Inc. Attorney Docket No. 10010272–1, USSN 09/883,694 filed with USPTO on Jun. 18, 2001, Inventors Julius K. Botka and Mike Powers.
Agilent Technologies, Inc. Attorney Docket No. 10011352–1, USSN 10/226,586 filed with USPTO on Aug. 23, 2002, Inventors Hubert Yeung, Michael T. Powers, and Wesley C. Whiteley.

* cited by examiner

*Primary Examiner*—Dinh T. Le
(74) *Attorney, Agent, or Firm*—Robert T. Martin

(57) ABSTRACT

Asymmetric support for high frequency transmission lines. An asymmetrical support structure coaxially supports a center conductor over a ground plane using a dielectric material. Absorbing material between the dielectric and the outer conductor reduces the effects of high order modes.

7 Claims, 3 Drawing Sheets

ASYMMETRIC SUPPORT FOR HIGH FREQUENCY TRANSMISSION LINES

BACKGROUND OF THE INVENTION

1. Field of the Invention

The present invention pertains to the art of transmission lines for high frequency electronics, and more particularly to the dielectric support structure for the center conductor of a coaxial transmission line.

2. Art Background

Transmission lines for high frequency signal propagation typically consist of two conductors separated by a material that can hold an electric charge (a dielectric). There are two important characteristics of a transmission line: its impedance and maximum operating frequency, both of which are determined by the relative size and spacing of the conductors, and the dielectric constant of the material separating them. Maximum operating frequency is limited by the fact that if the dimensions of the transmission line are greater than a certain fraction of the wavelength that is being propagated, then unwanted modes develop which are detrimental. Therefore, as the operating frequency of the transmission line increases, the characteristic dimensions of the transmission line components must be decreased. Control of line impedance is critical since a portion of the signal is reflected back whenever there is an impedance mismatch. As a result, it is necessary to maintain constant impedance through the entire signal path in order to minimize unwanted reflections.

Coaxial structures are a common form of transmission line with air typically used as the dielectric. Classical analysis shows that the characteristic impedance of a coaxial transmission line is proportional to the logarithm of the inner diameter of the outer conductor to the diameter of the inner conductor. To maintain the center conductor concentrically within the outer conductor a support structure is used, with the center conductor surrounded by a dielectric material. Glass or other ceramics are often used, with a glass-to-metal seal usually used as a support. Since the dielectric constant of the material used to support the center conductor is higher than that of air, something must be changed to maintain a constant impedance through the support structure. Either the diameter of the outer conductor must be increased, or the diameter of the inner conductor decreased to maintain proper impedance. It is more common to decrease the diameter of the inner conductor to prevent unwanted modes from developing as previously discussed. For frequencies in the millimeter-range, 80 GHz and above, the required diameter of the inner conductor is on the order of a few thousandths of an inch when it is decreased to maintain the characteristic impedance, usually on the order of 50 Ohms. As a result, the mechanical strength of the center conductor is severely compromised.

SUMMARY OF THE INVENTION

An asymmetrical support structure for a high-frequency transmission line consists of an outer conductor providing a ground plane, a center conductor maintaining a constant diameter coaxially supported above the ground plane by an electrically insulating material forming a dielectric, and electromagnetic absorbing material between the dielectric and the outer conductor in the area away from the ground plane.

BRIEF DESCRIPTION OF THE DRAWINGS

The present invention is described with respect to particular exemplary embodiments thereof and reference is made to the drawings in which.

DETAILED DESCRIPTION

Coaxial structures are a common form of transmission line with air typically used as the dielectric. Air has a dielectric constant $E_r = 1$. Other materials commonly used as dielectrics include fluorinated polymers such as PTFE with a dielectric constant around 2.45, and ceramics, glasses, and devitrified glasses (glass-ceramics) with dielectric constants from 4 to 10.

Figure 1:
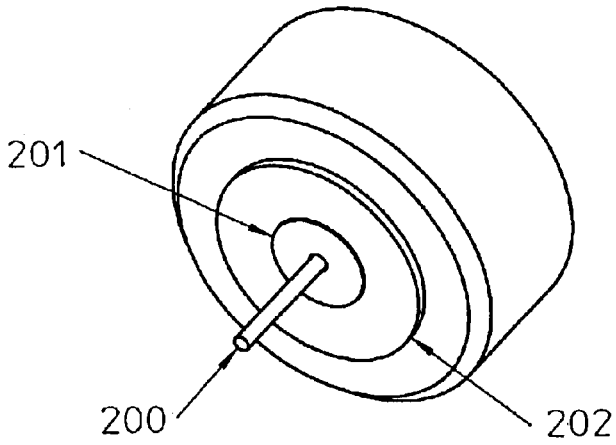
FIG. 1 Prior Art
FIG. 1 shows a coaxial structure known to the art.
Figure 2:
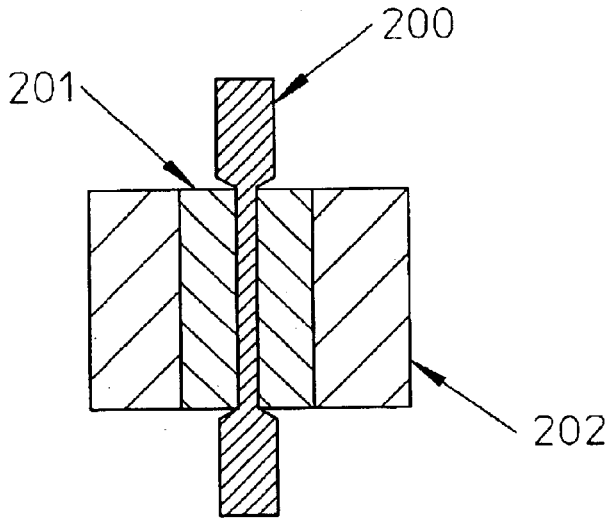
FIG. 2 Prior Art
FIG. 2 shows a lengthwise view of a coaxial structure known to the art.

To suspend the center conductor concentrically within the outer conductor, a support structure is needed, such as shown in FIG. 1. Such structures are also needed for connectors. Center conductor 200 is surrounded by dielectric 201 and outer conductor 202. Since the dielectric constant of the material used to support center conductor 200 is higher than that of air in the area of the support, the diameter of outer conductor 202 must be increased, or the diameter of inner conductor 200 decreased in order to maintain proper impedance, typically on the order of 50 ohms. It is more common to decrease the diameter of inner conductor 200, as shown in FIG. 2. Increasing the diameter of outer conductor 202 is likely to result in unwanted modes. For frequencies in the millimeter-range and above the required diameter of inner conductor 200 is on the order of a few thousandths of an inch when the center conductor diameter is decreased. As a result, the mechanical strength of center conductor 200 is severely compromised.

Figure 3:
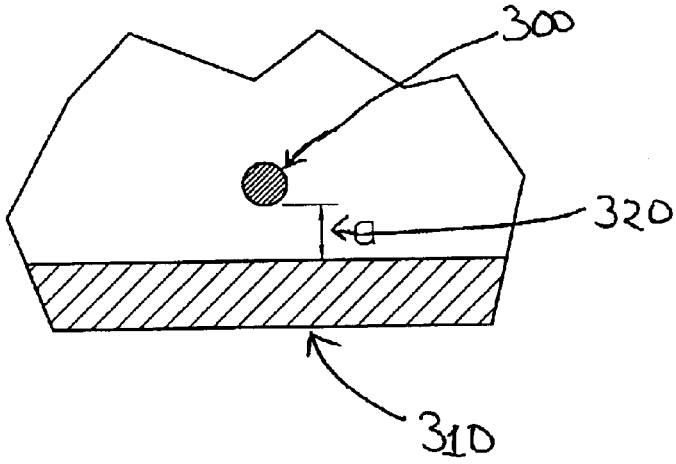
FIG. 3 Prior Art
FIG. 3 shows an embodiment of the transmission line according to the present invention.

To eliminate the need to reduce the diameter of the center conductor, the present invention incorporates a different form of transmission line in the region where the dielectric constant changes, such as at a connector or a support. FIG. 3 shows the classical case of a circular conductor 300 suspended over an infinite ground plane 310. In such a case, the characteristic impedance may be approximated as proportional to the logarithm of the height 320 of the conductor 300 above the ground plane 310 divided by the diameter of the conductor 300. In this configuration the maximum operating frequency is a function of the distance between the center conductor and ground plane, which can be easily and accurately controlled. As a result, the need to reduce the diameter of the center conductor in the support is eliminated.

Figure 4:
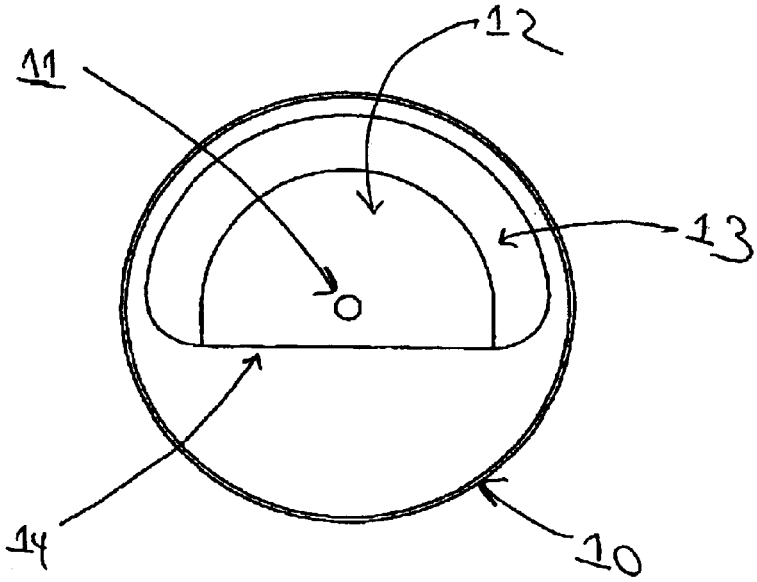
FIG. 4 shows the cross section of a support structure according to the present invention.

An embodiment of the invention is shown in FIG. 4. Outer conductor 10 has an asymmetrical bore which is concentric with the outer portion of outer conductor 10, and is truncated by ground plane 14. Center conductor 11 is coaxially supported by dielectric 12 over ground plane 14. Electromagnetic absorbing material 13 is provided between dielectric 13 and outer conductor 10 in the area away from ground plane 14.

In order to provide the necessary area for the electric field to develop and propagate in the area of the support, the width of the ground plane needs to be increased. This change in geometry creates a structure in which higher order modes can develop and interfere with signal propagation. Absorbing material 13 may be thought of as greatly reducing the effective Q of the cavity, rendering the effects of such higher order modes inconsequential. As shown in FIG. 4, absorbing material 13 is placed concentrically between dielectric 12 and outer conductor 10. The exact configuration and composition of absorbing material 13 is varied to reduce and/or eliminate unwanted modes, and may vary from the configuration shown. Electromagnetic absorbing material 13 is an ferromagnetic lossy material such as poly-iron, fine particles of iron in a nonconductive carrier. Glass, ceramics, a polymeric binder matrix, or other materials known to the art may also be used. In terms of wavelength, absorbing material 13 is far away from conductor 11, so the thickness and positioning of the layer of absorbing material 13 is not critical.

Figure 5:
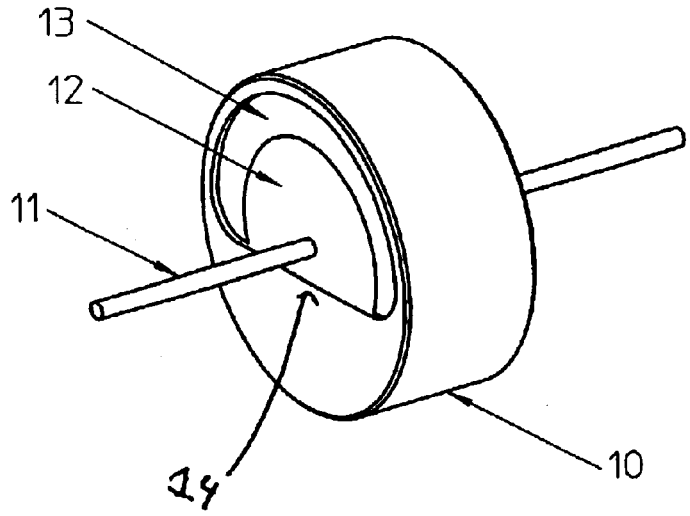
FIG. 5 shows another view of a support structure according to the present invention.

FIG. 5 shows an additional view of the support structure. In one embodiment of the invention suitable for use in the region of 110 GHz, the outside diameter of outer conductor 10 is approximately 4.76 millimeters. The width of the support structure is approximately 2.08 millimeters, although this may be extended to the point where the support structure shown is used as a transmission line. The diameter of center conductor 11 is approximately 0.254 millimeters. The distance from center conductor 11 to ground plane 14 is approximately 0.45 millimeters. When used with a dielectric 12 having a dielectric constant between 4.9 and 5.2 (glass, devitrified glass, or ceramic), and an absorbing band 13 of poly-iron with a thickness of approximately 0.60 millimeters, a characteristic impedance on the order of 50 ohms results. It should be appreciated that a range of dielectric materials may be used, ranging from fluorinated polymers, to ceramics, to glasses, with dielectric constants ranging from 2 to 12. At the very high frequencies used, however, materials used should be stable and have a low loss tangent.

While the classical configuration of FIG. 3 permits numerical modeling and simple approximations, the configuration of FIG. 4 is too complex to allow for closed-form solutions. Conceptually, it is clear that in the configuration of FIG. 3, while conductor 300 flies above an "infinite" conductive plane 310, the majority of the contributions to the resulting characteristic impedance must be from the section of the plane closest to the conductor, those contributions lessening as the distance from the conductor increases. Addition of absorbing material 13 around the periphery of the dielectric lowers the impedance somewhat, so that in practice the distance between center conductor 11 and ground plane 14 must be increased to offset the effect of absorbing material 13.

The placement of absorbing material 13 also depends on the manufacturing process used. Support structures known to the prior art such as shown in FIGS. 1 and 2 commonly use glass-to-metal seals, either matched glass-to-metal seals and compression glass-to-metal seals. In these cases, the assembly is comprised of a center conductor 200, glass bead (or frit) dielectric 201, and a conductive outer conductor sleeve 202. As is known to the art of manufacturing such seals, the coefficient of thermal expansion (CTE) for the materials used is important. Firing the assembly fuses the glass to the conductive elements.

With respect to the present invention, absorbing material 13 may either be molded in place either during or after the glass fuse process. If placed after the glass fuse process, the CTEs of outer conductor 10 and glass dielectric 12 should be matched to eliminate fracturing, which might otherwise occur upon cooling. If absorbing material 13 is set as part of the glass fuse process, there is more freedom in terms of the CTEs of the materials used, and a compression-type seal is possible.

Figure 6:
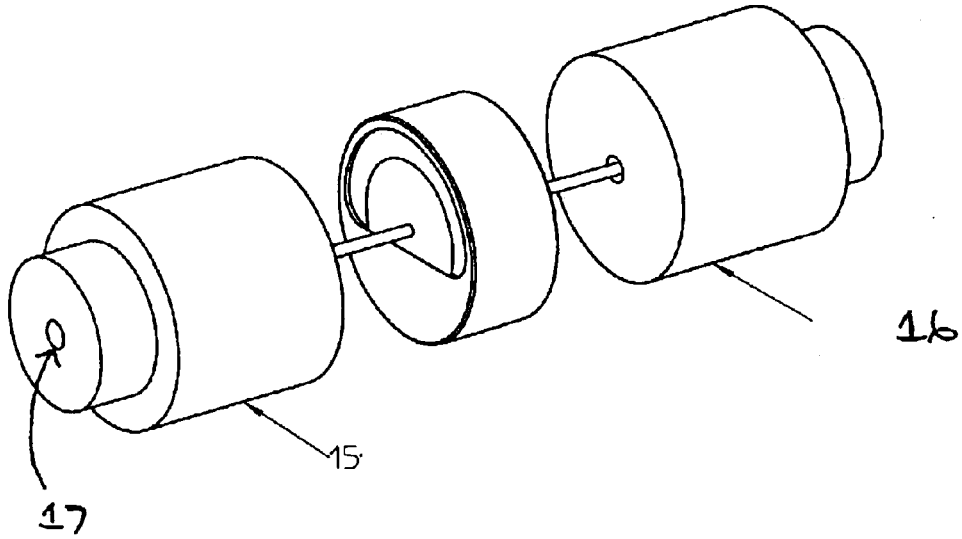
FIG. 6 shows a transmission line according to the present invention.

As shown in FIG. 6, an air-dielectric coaxial transmission line can be formed by pressing conductive sleeves 15 and 16 bored with the proper diameter to the support structure of FIG. 5. For a 50 ohm impedance, the diameter of bore 17 is on the order of 0.585 millimeters for an air dielectric.

The foregoing detailed description of the present invention is provided for the purpose of illustration and is not intended to be exhaustive or to limit the invention to the precise embodiments disclosed. Accordingly the scope of the present invention is defined by the appended claims.

What is claimed is:

1. A support structure for a coaxial transmission line comprising:

an outer conductor having a circular outer cross section and an asymmetrical inner bore, a portion of the inner bore concentric to the outer cross section, the remainder of the inner bore truncated by a flat section forming a ground plane, a dielectric material holding a center conductor coaxially with respect to the outer cross section of the outer conductor at a fixed height above the ground plane, and an electromagnetic absorbing material between a parallel section of the inner bore and the dielectric.

2. The support structure of claim 1 where the characteristic impedance of the support structure is approximately 50 ohms.

3. The support structure of claim 1 where the dielectric material is a fluorinated polymer.

4. The support structure of claim 1 where the dielectric material is a glass.

5. The support structure of claim 1 where the dielectric material is a ceramic.

6. The support structure of claim 1 where the dielectric material is a vitrified glass.

7. The support structure of claim 1 where the electromagnetic absorbing material is iron in a nonconductive binder.

* * * * *